US011554600B2

(12) United States Patent
Hashimoto

(10) Patent No.: US 11,554,600 B2
(45) Date of Patent: Jan. 17, 2023

(54) INK CASSETTE AND PRINTER

(71) Applicant: CANON KABUSHIKI KAISHA, Tokyo (JP)

(72) Inventor: Masaya Hashimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 17/153,264

(22) Filed: Jan. 20, 2021

(65) Prior Publication Data

US 2021/0237495 A1 Aug. 5, 2021

(30) Foreign Application Priority Data

Jan. 31, 2020 (JP) ..... JP2020-015531

(51) Int. Cl.
*B41J 32/00* (2006.01)
*B41J 2/32* (2006.01)

(52) U.S. Cl.
CPC ..... *B41J 32/00* (2013.01); *B41J 2/32* (2013.01)

(58) Field of Classification Search
CPC ..... B41J 32/00; B41J 2/32; B41J 2/325
See application file for complete search history.

(56) References Cited

U.S. PATENT DOCUMENTS

| | | | |
|---|---|---|---|
| 5,777,652 | A | 7/1998 | Takeuchi |
| 9,067,447 | B2 | 6/2015 | Suzuki |
| 2007/0274756 | A1 | 11/2007 | Motoki |

FOREIGN PATENT DOCUMENTS

| | | | |
|---|---|---|---|
| CN | 1135971 | A | 11/1996 |
| CN | 101077664 | A | 11/2007 |
| CN | 101077665 | A | 11/2007 |
| CN | 101331026 | A | 12/2008 |
| CN | 101870207 | A | 10/2010 |
| CN | 102079174 | A | 6/2011 |
| CN | 102343728 | A | 2/2012 |
| CN | 104417104 | A | 3/2015 |
| JP | 2007-229937 | A | 9/2007 |
| JP | 2015051518 | A | 3/2015 |

*Primary Examiner* — Kristal Feggins
(74) *Attorney, Agent, or Firm* — Canon U.S.A., Inc. I.P. Division

(57) ABSTRACT

An ink cassette capable of being mounted in a printer includes a supply bobbin, a winding bobbin, a plate member, and at least three engaging portions. The plate member is provided on an end part of the ink cassette on a near side of the ink cassette in a mounting direction of the ink cassette. The at least three engaging portions are provided in the plate member and engage with engaging portions of the printer when the ink cassette is mounted in the printer. In a case where the ink sheet, pulled out from the supply bobbin, and a print sheet are overlaid and pressed against a print head of the printer, ink is transferred from the ink sheet to the print sheet.

20 Claims, 8 Drawing Sheets

INK CASSETTE AND PRINTER

BACKGROUND

Field

The present disclosure relates to an ink cassette and a printer.

Description of the Related Art

In recent years, printing devices that make it possible to easily print photographic image data captured by image capturing devices such as digital cameras and smartphones have become common. A thermal printer, which uses a thermal head, is one example of such a printing device. In a thermal printer, an ink cassette is mounted along a longer direction of the thermal head, which results in a large opening being formed in one side wall portion of a chassis. On the other hand, head shaft support portions which support the thermal head so that the thermal head can be raised/lowered are provided in both side wall portions of the chassis. To print, the thermal head presses against a platen rotatably supported by the chassis, and thus a strong counterforce acts on the head shaft support portions. Because a large opening is formed in the chassis, there is a drastic loss of strength. As a result, the chassis deforms under the counterforce from the pressure of the thermal head during printing, and the desired pressure contact force cannot be applied to the thermal head, which may result in a drop in printing quality.

Japanese Patent Laid-Open No. 2007-229937 discloses a technique for preventing deformation of an ink cassette due to a force generated inside the printer, which prevents a drop in printing quality.

However, the technique disclosed in Japanese Patent Laid-Open No. 2007-229937 cannot compensate for the loss of strength due to the opening formed in the printer main body, which may result in a drop in printing quality.

SUMMARY

As provided in more detail below, a loss of strength in a printer main body can be compensated for, and a drop in printing quality can be reduced. An ink cassette and printer may be configured to compensate for a loss of strength in a printer main body and reduce a drop in printing quality.

According to an aspect of the present disclosure, an ink cassette capable of being mounted in a printer includes a supply bobbin on which an ink sheet, that is long and coated with ink, is wound, a winding bobbin on which the ink sheet pulled out from the supply bobbin is wound, a plate member provided on an end part of the ink cassette on a near side of the ink cassette in a mounting direction of the ink cassette, and at least three engaging portions provided in the plate member and configured to engage with engagement portions of the printer when the ink cassette is mounted in the printer, wherein, in a case where the ink sheet, pulled out from the supply bobbin, and a print sheet are overlaid and pressed against a print head of the printer, ink is transferred from the ink sheet to the print sheet.

According to the present disclosure, a loss of strength in a printer main body can be compensated for, and a drop in printing quality can be reduced.

Further features of the present disclosure will become apparent from the following description of exemplary embodiments with reference to the attached drawings.

DESCRIPTION OF THE EMBODIMENTS

Embodiments will be described hereinafter in detail, with reference to the accompanying drawings. Note that the following embodiments do not limit the disclosure as set forth in the scope of patent claims. Although several features are described in the embodiments, all of these features are not necessarily required for the disclosure, and multiple features may be combined as desired. Furthermore, in the accompanying drawings, the same or similar configurations are given the same reference signs, and redundant descriptions thereof will be omitted.

An example in which the present disclosure is applied in a thermal printer that uses thermal transfer or dye sublimation will be described hereinafter. However, the present disclosure is not limited to a thermal printer or an ink cassette, and can be applied in other types of printers and ink cassettes as well.

Additionally, the present disclosure is not limited to a printer alone, and can be applied in any device having a printing function, such as a copier, a facsimile device, a computer system, or the like. "Recording sheet" according to the present disclosure includes not only paper material, but also sheet materials made from other types of material, such as plastic film or the like.

In a thermal printer, an ink ribbon to which ink is applied (an ink sheet) and recording sheet are pressurized by a thermal head (a print head) and a platen roller (a receiving member), and printing is performed by conveying the ink ribbon and the recording sheet (print sheet) in a state of contact with the thermal head. A plurality of thermal elements (resistance elements) are disposed in a line shape in the thermal head, and an image is printed onto the recording sheet by selectively electrifying the heating elements so as to transfer the ink from the ink ribbon onto the recording sheet. In particular, when printing in full color, yellow (Y) magenta (M), and cyan (C) inks, which are applied to the ink ribbon in order, are superimposed on each other in that order to form a full-color image, and an overcoat (OP) is also transferred onto the image.

In the following descriptions, "printing" is assumed to refer to an overall series of operations, from printing on the basis of a printing instruction from a user, to discharging recording sheet onto which an image has been printed. An "image being printed" is assumed to refer to an operation, among the printing operations, of forming an image on the recording medium by thermally transferring ink from the ink ribbon onto the recording sheet. Note that with monochromatic printing, the recording sheet may be in the form of a roll, and may be discharged after being cut to a predetermined size after an image is printed.

Apparatus Configuration

The overall configuration of a thermal printer according to the present embodiment will be described with reference to FIGS. 1A and 1B.

Figure 1A:
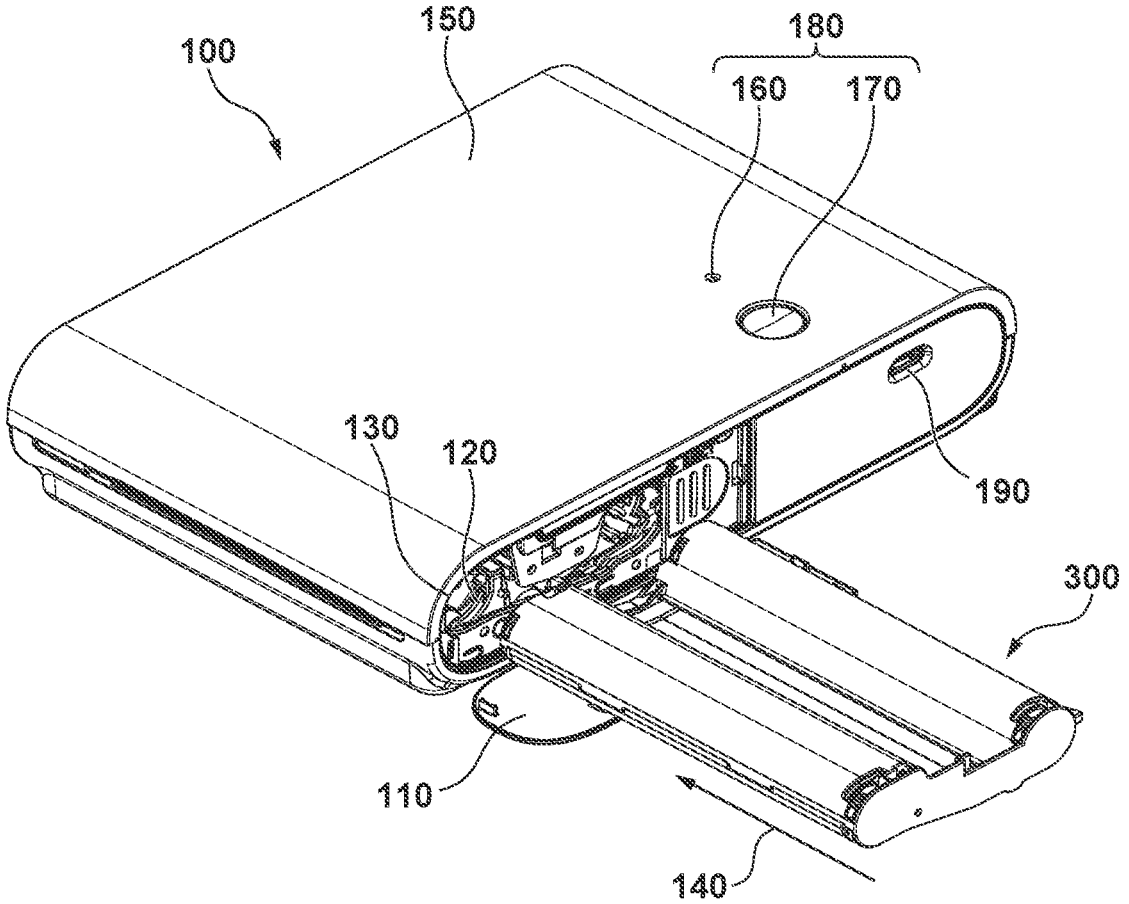
FIGS. 1A and 1B are perspective views illustrating the external configuration of a printer and an ink cassette according to an embodiment.
Figure 1B:
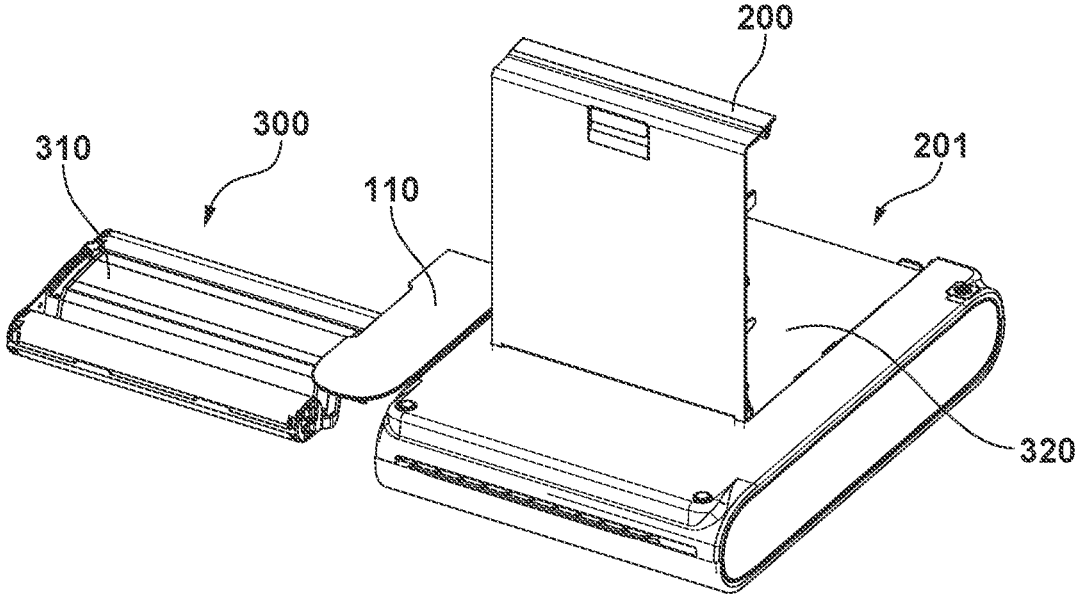

FIG. 1A is a perspective view of the external configuration of a printer 100 and an ink cassette 300 according to the present embodiment, seen from above. FIG. 1B is a perspective view of the external configuration of the printer 100 and the ink cassette 300 according to the present embodiment, seen from below.

The printer 100 includes a main body case 150, which is an exterior housing member that covers an upper side and a lower side of a printer main body. A cassette cover 110, which is capable of opening and closing, is provided on one side surface of the main body case 150. The cassette cover 110 is capable of opening and closing a cassette mounting portion 130, which is an opening provided in a chassis 120. The ink cassette 300 can be inserted into and removed from the printer 100 through the cassette mounting portion 130. The ink cassette 300 can be mounted, in the direction of an arrow 140, within the printer 100 from the cassette mounting portion 130 of the chassis 120, when the cassette cover 110 is open, and can be removed to the exterior of the printer 100 in the direction opposite from the direction of the arrow 140. The ink cassette 300 contains a long ink ribbon, which is conveyed along with recording sheet 320 when printing an image. The ink cassette 300 will be described in detail later.

A user interface (UI) unit 180, including a display unit 160 and an operating unit 170, is provided in an upper surface of the main body case 150. The display unit 160 includes a plurality of light-emitting elements such as LEDs, and displays an operating state of the printer 100 through colored light, lighting up, flashing, or the like. The operating unit 170 receives operating instructions such as turning the printer 100 on and off. Upon receiving a printing instruction in which a desired image is selected from a host device while the power is on, the printer 100 starts printing according to the printing instruction.

Additionally, an external connection terminal 190 is provided in one side surface of the main body case 150, which makes it possible to use a USB cable or the like to connect an AC adapter and charge a battery provided within the main body case 150, connect an external device such as a digital camera or smartphone, and so on. The printer 100 is capable of receiving image data from a host device connected through the external connection terminal 190 and printing the image data.

Additionally, a tray cover 200, which can be opened and closed, is provided on a bottom surface of the main body case 150, and by opening the tray cover 200, a specified number of sheets of the recording sheet 320 can be loaded into a sheet storage unit 201. A user loads the recording sheet 320 of a specified size into the sheet storage unit 201, and during printing, one sheet is pulled out from the sheet storage unit 201 by a sheet feed mechanism (not shown) of the printer 100. A full-color image is printed by using a thermal head 330 to transfer yellow (Y), magenta (M), and cyan (C) color inks (described later with reference to FIG. 2) applied to an ink ribbon 310, as well as an overcoat (OP), onto the recording sheet 320.

Figure 2:
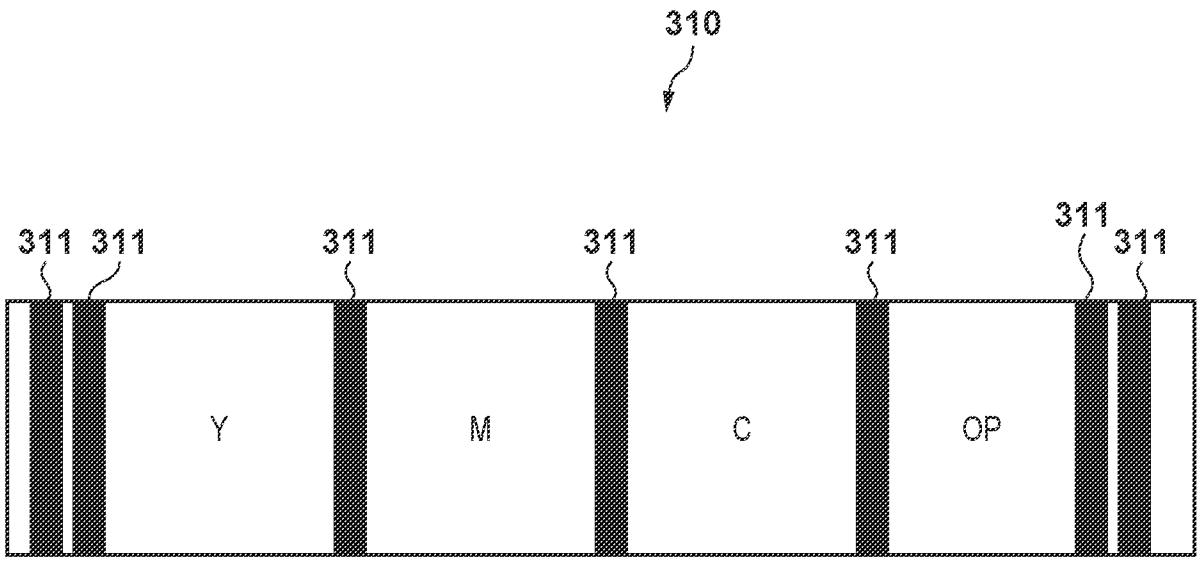
FIG. 2 is an expanded view of an ink ribbon according to the embodiment.

The configuration of the ink ribbon 310 will be described next with reference to FIG. 2. FIG. 2 is an expanded view of the ink ribbon 310 according to the present embodiment.

In the case of full-color printing, yellow (Y), magenta (M), and cyan (C) color inks are arranged on the ink ribbon 310. A full-color image is formed by overlaying each ink color on the recording sheet 320 to print an image, and an overcoat (OP) surface is furthermore formed on the image. Black band-shaped markers 311 are provided between each color of ink for a purpose of detecting the starting position of each color of ink, and two of the markers are provided at the start of the yellow (Y) surface in order to distinguish yellow from the other colors. The ink ribbon according to the present embodiment uses a highly heat-resistant film, such as polyethylene terephthalate, having a resistance to heat that meets a predetermined level, with a thickness of approximately 2 to 10 or more microns, as a base material. The yellow (Y), magenta (M), and cyan (C) inks are sublimation inks prepared by mixing dyes, binders, plasticizers, binding agents, and the like, and have a thickness of approximately 0.2 to 5 μm on the film. The transparent and colorless overcoat surface is formed by applying a styrose derivative, styrene resin, styrene copolymer resin, a binder, or the like at a thickness of approximately 0.5 to 5 μm. On the surface on the side opposite from the surface to which the ink is applied, a lubricant is applied to reduce frictional resistance with the thermal head and stabilize the travel of the ink ribbon, an abrasive agent is applied to polish and clean the surface of the thermal head, and so on.

A sequence of operations performed when the printer 100 according to the present embodiment prints will be described next with reference to FIGS. 3A to 3E and 4A to 4B.

Figure 3A:
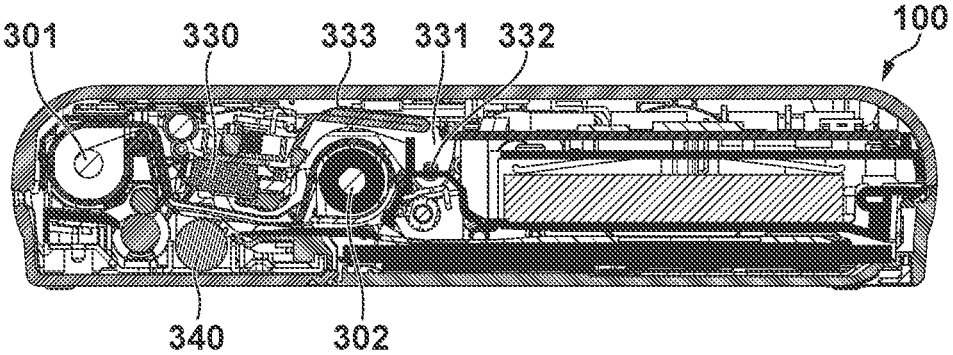
FIGS. 3A to 3E are cross-sectional side views illustrating operations when the printer according to the embodiment prints.
Figure 3B:
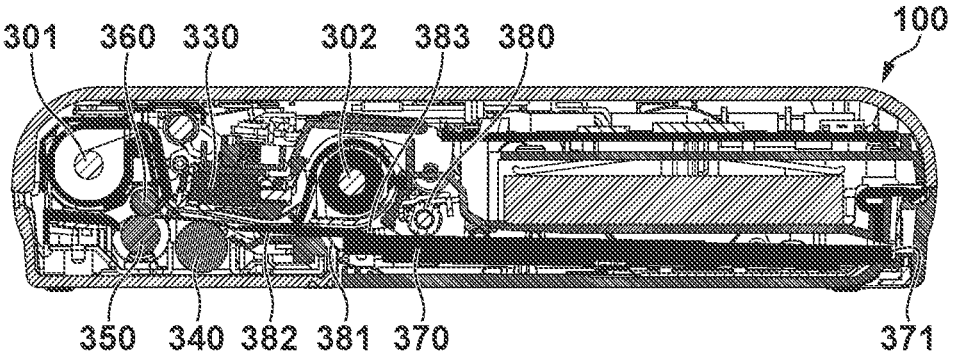
Figure 3C:
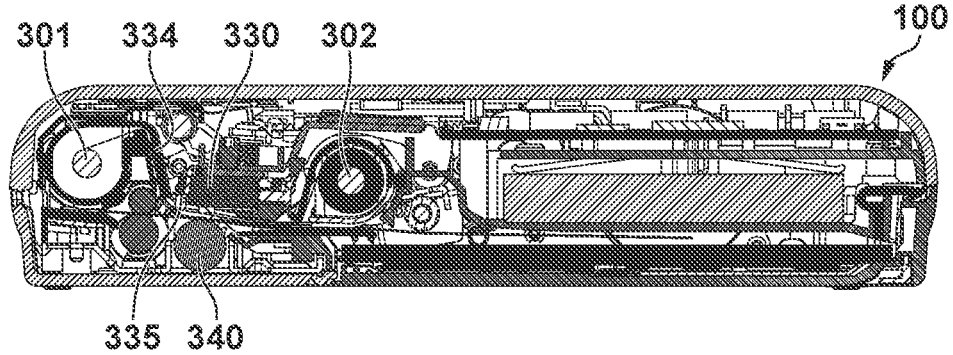
Figure 3D:
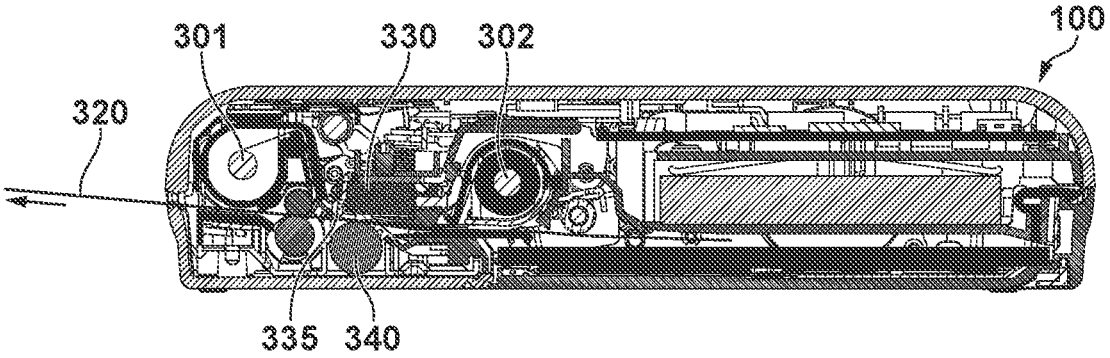

FIGS. 3A to 3E are cross-sectional side views illustrating operations performed when the printer 100 according to the present embodiment prints, where FIG. 3A illustrates a standby state; FIG. 3B, a sheet feed state; FIG. 3C, a cueing state; FIG. 3D, a state during printing; and FIG. 3E, a cross-section illustrating the primary elements indicated in FIG. 3D. FIGS. 4A and 4B are flowcharts illustrating a sequence of operations performed when the printer 100 according to the present embodiment prints.

When the user sets the ink cassette 300 in the printer 100, loads the recording sheet 320 into the sheet storage unit 201, and turns the power on using the operating unit 170, the printer 100 enters the standby state. When, in the standby state, image data begins being received from a host device, the LED of the display unit 160 flashes to indicate that the data is being loaded. The printer 100 includes the thermal head 330 and a platen roller 340. In the thermal head 330, a head arm 331 is rotatably supported by a head support shaft 332, and is biased by a head raising spring 333 in what is the clockwise direction in the drawings. The thermal head 330 is restricted to a position that maximizes the distance from the platen roller 340 so as not to interfere with the ink cassette 300 during mounting.

Next, when the image data has been successfully received from the host device, and the LED in the display unit 160 switches from flashing to being constantly on, the printing operations by the printer 100 start (step S101). Upon the printing operations being started, the printer 100 uses a driving mechanism (not shown) to cause the thermal head 330 to rotate, in what is the counterclockwise direction in the drawings, about the head support shaft 332, against a biasing force produced by the head raising spring 333. As illustrated in FIG. 3B, the thermal head 330 moves to an intermediate position midway between a standby position, illustrated in FIG. 3A, and a printing position, which forms a nip with the platen roller 340 (step S102). When the movement of the thermal head 330 is complete, the printer 100 starts sheet feed operations (step S103). When the sheet feed operations are started, a pressure plate 370 provided in the printer 100 is rotated by a biasing mechanism (not shown) about a pressure plate rotation shaft 371 in what is the clockwise direction in the drawings, and pushes the recording sheet 320, which has been loaded in the sheet storage unit 201, upward against a sheet feed roller 380. At this time, the sheet feed roller 380 is rotated in what is the clockwise direction in the drawings by driving force from a sheet conveying motor (not shown), and conveys the recording sheet 320 toward a printing section which includes the thermal head 330 and the platen roller 340. The recording sheet 320 makes contact with a separating portion 381 of the printer 100, and as a result, only the uppermost sheet of the recording sheet 320 is conveyed. The conveyed recording sheet 320 is detected by a sheet detecting sensor (not shown), and it is confirmed that there are no issues with the sheet feed operations.

Once it is confirmed that there are no issues with the sheet feed operations, the pressure plate 370 is rotated to the standby state illustrated in FIG. 3A by the biasing mechanism (not shown) so that the next sheet of the recording sheet 320 in the sheet storage unit 201 is not mistakenly conveyed. Then, the recording sheet 320 conveyed by the sheet feed roller 380 is rotated in what is the clockwise direction in the drawings by pressing upward on a changeover plate 382, which is supported by a changeover plate rotation shaft 383 so as to be capable of rotating, and enters a nip area between a convey roller 350 and a convey slave roller 360. A plurality of minute protrusions which contact the back surface of the recording sheet 320 are formed in the convey roller 350, and can contact the recording sheet 320 so as to accurately convey the recording sheet 320. The convey roller 350 is driven by a stepping motor (not shown), and the feed rate can therefore be accurately controlled. The conveyance of the recording sheet 320 by the convey roller 350 and the convey slave roller 360 is continued, and once a trailing edge of the recording sheet 320 has passed the changeover plate 382, the recording sheet 320 is conveyed by a predetermined amount in the opposite direction and stops at a printing start position (step S104). Once the sheet feed operations are complete and the recording sheet 320 stops at the printing start position, operations for cueing the yellow (Y) part of the ink ribbon 310 are performed (step S105). The ribbon cueing operations will be described hereinafter. Once the recording sheet 320 has been conveyed to the printing start position illustrated in FIG. 3C, the ink ribbon 310 held within the ink cassette 300 is pulled out. In other words, an end part of a winding bobbin 301 of the ink cassette 300 engages with an engagement portion provided in the printer 100 and is rotated in what is the counterclockwise direction in the drawings by a driving mechanism (not shown), and as a result, the ink ribbon 310 wound upon a supply bobbin 302 is pulled out and wound upon the winding bobbin 301. As illustrated in FIG. 2, the markers are provided at the beginning of each color of ink in the ink ribbon 310, and two of the markers are provided at the start of the yellow (Y) part. When a ribbon detecting sensor 334, which is a reflective optical sensor, detects that reflected light has been blocked by the marker 311 provided in the ink ribbon 310, the printer 100 stops the winding of the ink ribbon 310 and performs the cueing. The cueing of the yellow (Y) part is determined in accordance with whether or not two of the markers have been detected (step S106). If, when cueing the yellow (Y) part, only one marker has been detected, or no markers have been detected in a predetermined amount of time, it is assumed that the ink cassette 300 has malfunctioned, and a state expressing an error is displayed in the display unit 160 (step S107). Then, the thermal head 330 is moved to the standby position illustrated in FIG. 3A, and the printing operations end (step S129).

During the cueing operations, the ink ribbon 310 is conveyed at a faster speed than the printing in order to reduce the amount of time required for printing. That is, the speed at which the supply bobbin 302 rotates increases, which increases inertia. As described above, the conveyance of the ink ribbon 310 stops when the markers 311 provided in the ink ribbon 310 are detected, but the supply bobbin 302 will try to keep rotating due to its own weight and inertia produced by the wound ink ribbon 310. If the supply bobbin 302 continues rotating, an unneeded part of the ink ribbon 310 will be pulled out, which causes issues such as ink ribbon jams and the like. To prevent this, the supply bobbin 302 is provided with a sliding part that produces a small amount of rotational resistance.

Once the cueing of the yellow (Y) part is complete, the thermal head 330 is rotated further about the head support shaft 332 in what is the counterclockwise direction in the drawings, and moves to a printing position, in which the ink ribbon 310 and the recording sheet 320 are tightly held between the thermal head 330 and the platen roller 340 (step S108). Once the thermal head 330 has moved to the printing position, the recording sheet 320 and the ink ribbon 310 remain tightly held between the thermal head 330 and the platen roller 340, as illustrated in FIG. 3D; and in this state, the ink on the ink ribbon 310 is heated by the thermal head 330 and transferred onto the recording sheet 320 while being conveyed in a direction indicated by an arrow A, and an image is printed as a result (step S109). During the printing, the ink ribbon 310 and the recording sheet 320 are conveyed at the same speed, and thus an ink ribbon convey mechanism of the printer 100 incorporates a torque limiter (not shown) which slips when a load greater than or equal to a set torque is produced.

When an image is printed as a result of the heating performed by the thermal head 330, the ink ribbon 310 and the recording sheet 320 are conveyed for a set distance while remaining in a state of close contact, and are then conveyed in directions away from each other. In other words, the recording sheet 320 is conveyed in the direction of the arrow A by the convey roller 350, and the ink ribbon 310 is conveyed toward the winding bobbin 301 of the ink cassette 300 while sliding along a separating plate 335 of the thermal head 330. Although the ink ribbon 310 has adhered to the recording sheet 320 as a result of being heated by the thermal head 330 during printing, the ink ribbon 310 is conveyed to the position of the separating plate 335 and is separated from the recording sheet 320. If the image to be printed is a high-gradation image, a high density is required. Accordingly, more heat is applied to the ink ribbon 310 to diffuse more ink onto the recording sheet 320.

The ink ribbon 310 is constituted by polyethylene terephthalate film as mentioned above, and therefore shrinks when heat is applied. Particularly when printing high-gradation images, a large amount of heat is applied to the ink ribbon 310, which causes the ink ribbon 310 to shrink greatly. When this happens, the ink ribbon 310 wound around the supply bobbin 302 is pulled out due to the shrinkage, which causes the ribbon to twist, sag, wrinkle, and so on. Twisting and wrinkles can lead to color loss, which causes a drop in the printing quality. In order to prevent such a situation in which the printing quality drops, a configuration that creates an appropriate rotational resistance in the rotational shaft of the supply bobbin 302, so that the supply bobbin 302 is not easily pulled out under the effect of a relatively minute force such as that produced by shrinkage, is effective. As described above, the configuration is such that a small rotational resistance is produced in the rotational shaft of the supply bobbin 302. This configuration, that produces rotational resistance, not only prevents the ink ribbon 310 from loosening when the cueing operations are stopped, but also functions to improve resistance to wrinkling.

The distance of the separating plate 335 from the heating elements of the thermal head 330 is optimized to a value necessary for the ink diffused and transferred from the ink ribbon 310 to the recording sheet 320 to be sufficiently cooled and fixed. Once the yellow image region has been printed onto the recording sheet 320, a driving mechanism (not shown) of the printer 100 rotates and retracts the thermal head 330 to the position illustrated in FIG. 3C (step S110). Then, the recording sheet 320 is conveyed in the direction opposite from that used in the printing operations, to the position illustrated in FIG. 3C, and is moved to the printing start position as a result (step S111). Thereafter, the ink ribbon 310 is wound and conveyed in the same manner as in the operations for printing the yellow (Y) part, and is conveyed to and stopped at the printing start position by detecting the markers 311, after which a magenta (M) part is printed (steps S112 to S115). In the same manner, the cueing is performed by detecting the markers for cyan (C) and the overcoat (OP), and the cyan (C) and overcoat (OP) parts are printed as well (steps S116 to S127). When the printing of the overcoat (OP) is complete, the recording sheet 320 is conveyed further in the direction of the arrow A in FIG. 3D, and when the trailing edge of the recording sheet 320 passes the convey roller 350, the discharge of the sheet is complete (S128). Once the discharge is complete, the thermal head 330 is rotated to the standby position, illustrated in FIG. 3A, by the driving mechanism (not shown), and the printing operations end (step S129).

Figure 3E:
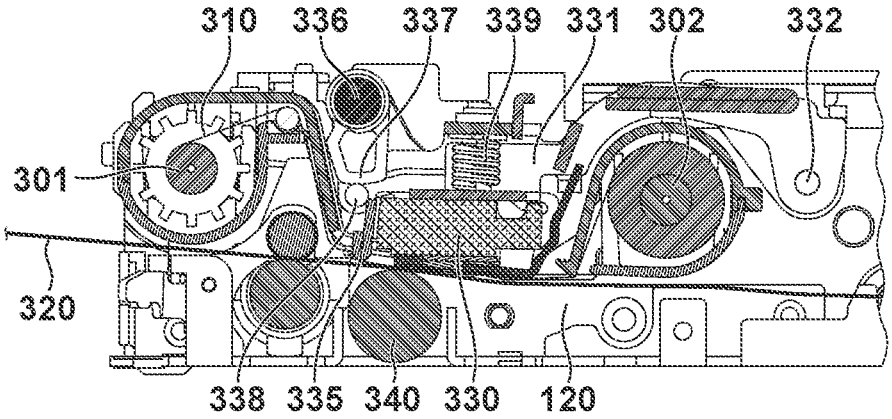
Figure 4A:
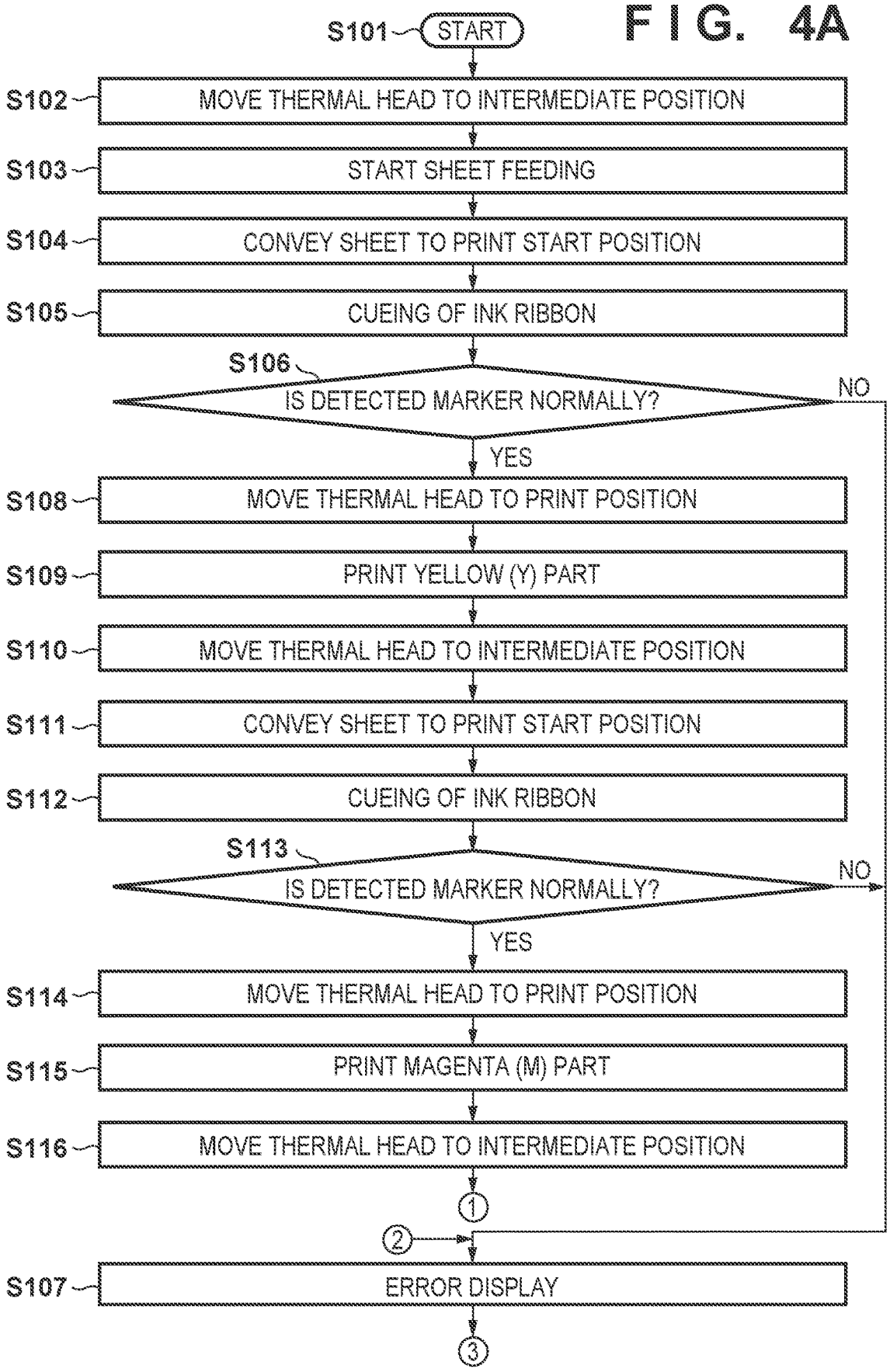
FIGS. 4A and 4B are flowcharts illustrating a sequence of operations performed when the printer according to the embodiment prints.
Figure 4B:
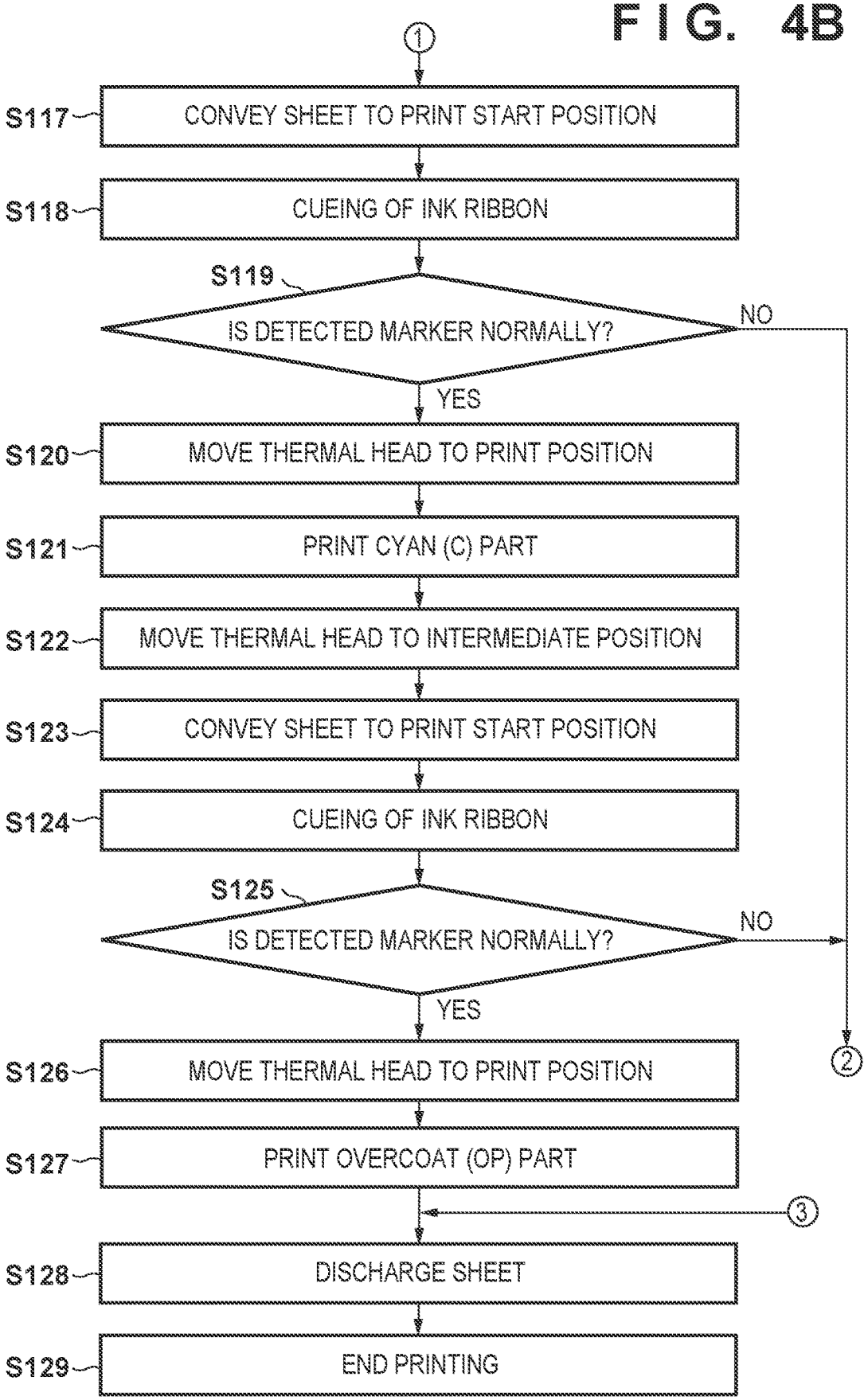

FIG. 3E is a cross-sectional view of the primary elements used during printing, illustrated in FIG. 3D. As described above, in the printing state, the thermal head 330 is pressurized by the platen roller 340 while the ink ribbon 310 and the recording sheet 320 are held between the thermal head 330 and the platen roller 340. The thermal head 330 can move to a position of being pressed against the platen roller 340, and a position of being separated from the platen roller 340, using a raising/lowering mechanism. Specifically, the thermal head 330 held on the head arm 331 is rotated counterclockwise in FIG. 3D about the head support shaft 332. This is implemented by rotating a pressure contact cam shaft 336 in what is the clockwise direction in the drawings using a driving mechanism (not shown) so that a pressure contact cam 337 pushes a pressure contact cam follower 338, which is provided integrally with the head arm 331, downward, causing the pressure contact cam follower 338 to rotate against the biasing force of the head raising spring 333. The thermal head 330 is attached to the head arm 331 via a pressure contact spring 339, and when the pressure contact cam 337 is rotated a predetermined amount, the head arm 331 pushes the head raising spring 333 down by a predetermined amount. Accordingly, the thermal head 330 is pushed against the platen roller 340 by the counterforce of the pressure contact spring 339. Thus although the ink ribbon 310 and the recording sheet 320 are in close contact with each other due to the counterforce of the pressure contact spring 339, it is necessary to bring the ink ribbon 310 into close contact with the recording sheet 320 with a relatively large force in order to more smoothly transfer the ink to the recording sheet 320. In the present embodiment, the thermal head 330 is four inches long and is pressurized with a strong force of three N or more. In this manner, during printing, a large force is used to make the pressure contact, and the force is supported by a bearing portion of the pressure contact cam shaft 336 and a bearing portion of the platen roller 340 provided in the chassis 120.

Through the foregoing, the printing operations, in which the inks are layered in the order of yellow (Y), magenta (M), cyan (C), and the overcoat (OP) and are transferred, are completed.

The configuration of the ink cassette 300 will be described in detail next with reference to FIGS. 5A and 5B.

Figure 5A:
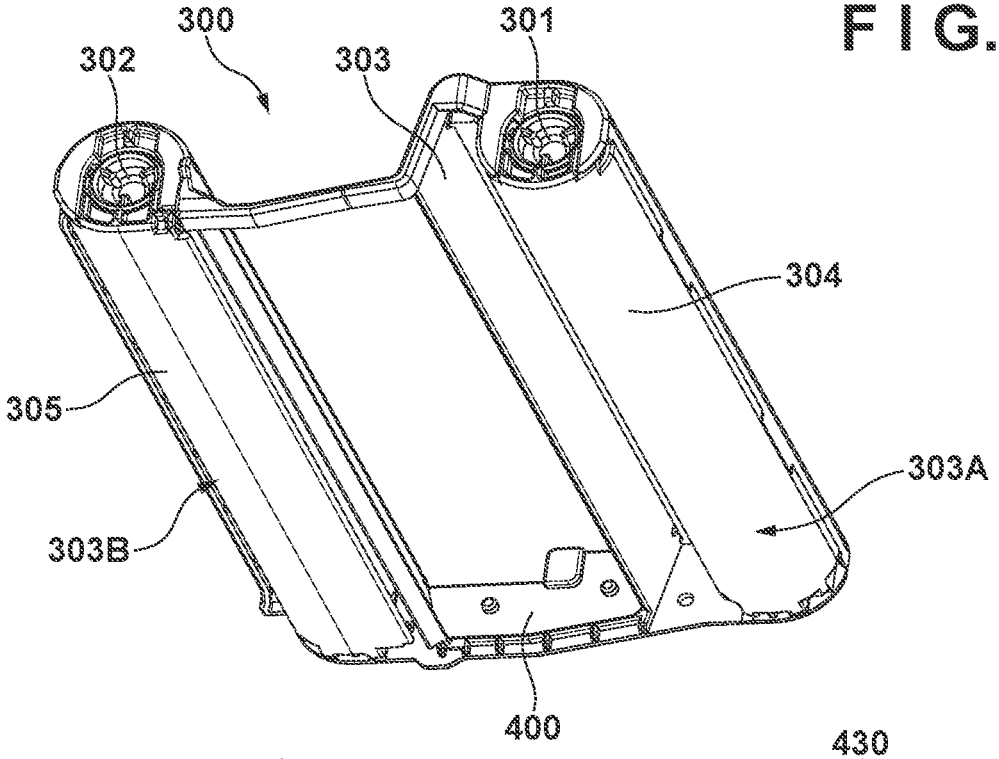
FIGS. 5A and 5B are perspective views of the ink cassette according to the embodiment.
Figure 5B:
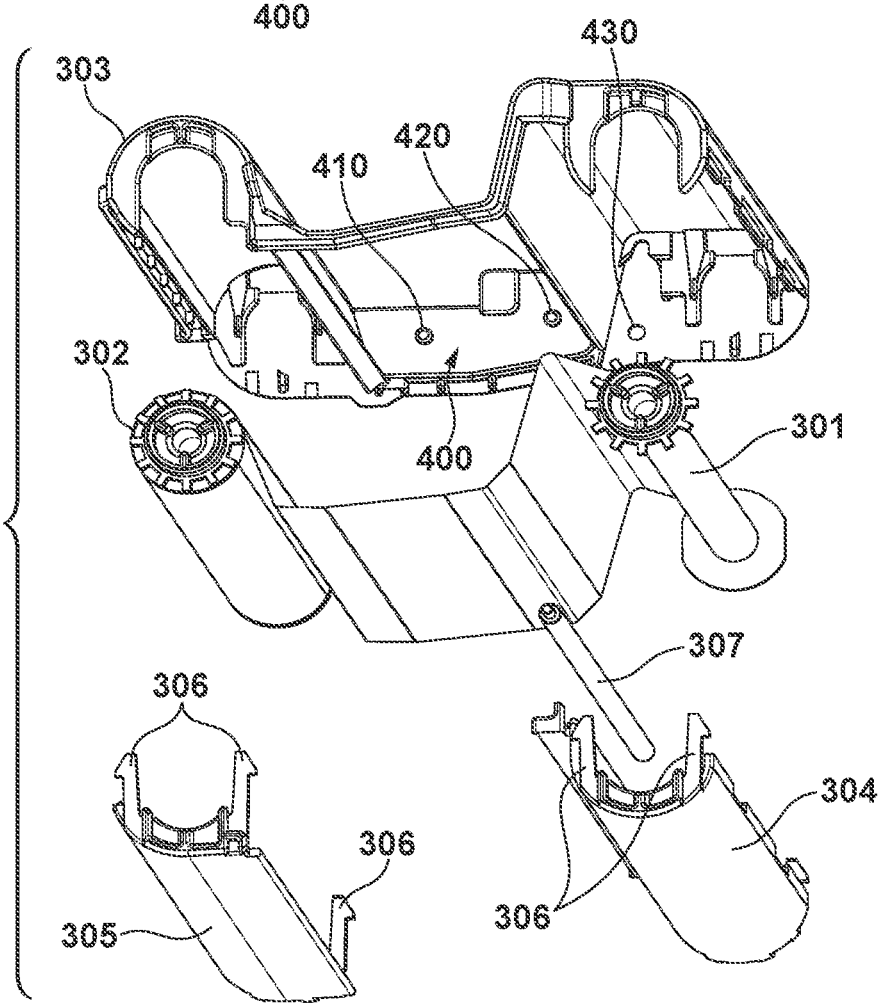

FIGS. 5A and 5B are perspective views of the ink cassette 300 according to the present embodiment, where FIG. 5A is a perspective view of the ink cassette 300 seen from below, and FIG. 5B is an exploded perspective view of FIG. 5A.

As illustrated in FIG. 5A, the ink cassette 300 includes a winding bobbin storage portion 303A that holds the winding bobbin 301 and a supply bobbin storage portion 303B that holds the supply bobbin 302. The winding bobbin storage portion 303A and the supply bobbin storage portion 303B are open at end parts thereof on a far side in a mounting direction of the printer 100, and the configuration is such that when the ink cassette 300 is mounted in the printer 100, the driving mechanism of the printer 100 is capable of engaging with the winding bobbin 301 and the supply bobbin 302.

The ink ribbon 310 is contained within a cassette case 303, wound upon the supply bobbin 302 and with another end attached to the winding bobbin 301. The cassette case 303 is manufactured by injection-molding a high-strength engineering plastic such as ABS or PC to ensure sliding performance with respect to the ink ribbon 310, conveyance performance, and so on, which will be described later.

The cassette case 303 has a configuration in which both end parts of two semicylinders are connected, and open portions of the two semicylinders are covered by a winding bobbin cover 304 and a supply bobbin cover 305, with the two semicylinders disposed parallel to each other. The winding bobbin cover 304 and the supply bobbin cover 305 are integrated by having engagement claws 306, four each of which are provided near both end parts of those covers, engage with engagement holes provided in the cassette case 303. Like the cassette case 303, the winding bobbin cover 304 and the supply bobbin cover 305 are injection-molded components.

End parts of the winding bobbin cover 304 and the supply bobbin cover 305 on a near side in the mounting direction of the printer 100 are connected by a connecting portion 400 constituted by a substantially flat, thin plate member having a surface area that is as broad as possible. The connecting portion 400 is provided with a protrusion-shaped positioning boss 410 and a restricting boss 420 as engagement portions, and a positioning hole 430 as an engaged portion, that engage with the chassis 120 during mounting in the printer 100. Positional relationships between the ink cassette 300, and the printer 100 and chassis 120, will be described later.

The winding bobbin 301 and the supply bobbin 302 are rotatably supported within the winding bobbin storage portion 303A and the supply bobbin storage portion 303B, respectively, of the cassette case 303. The winding bobbin 301 and the supply bobbin 302 have the same shape, and are injection-molded components made using a high-strength resin material such as ABS or PS.

The ink ribbon 310 is bent at a guide shaft 307 rotatably supported by the cassette case 303, and is disposed so as to pass through an opening formed between the cassette case 303, and the winding bobbin cover 304 and supply bobbin cover 305. The guide shaft 307 is made of injection-molded 30% PBT-G, which is a high-strength resin, and has a large-diameter portion which makes contact with the ink ribbon 310 and small-diameter portions provided at both end parts of the large-diameter portion.

Positional relationships between the ink cassette 300, and the printer 100 and chassis 120, will be described next with reference to FIGS. 6A and 6B.

Figure 6A:
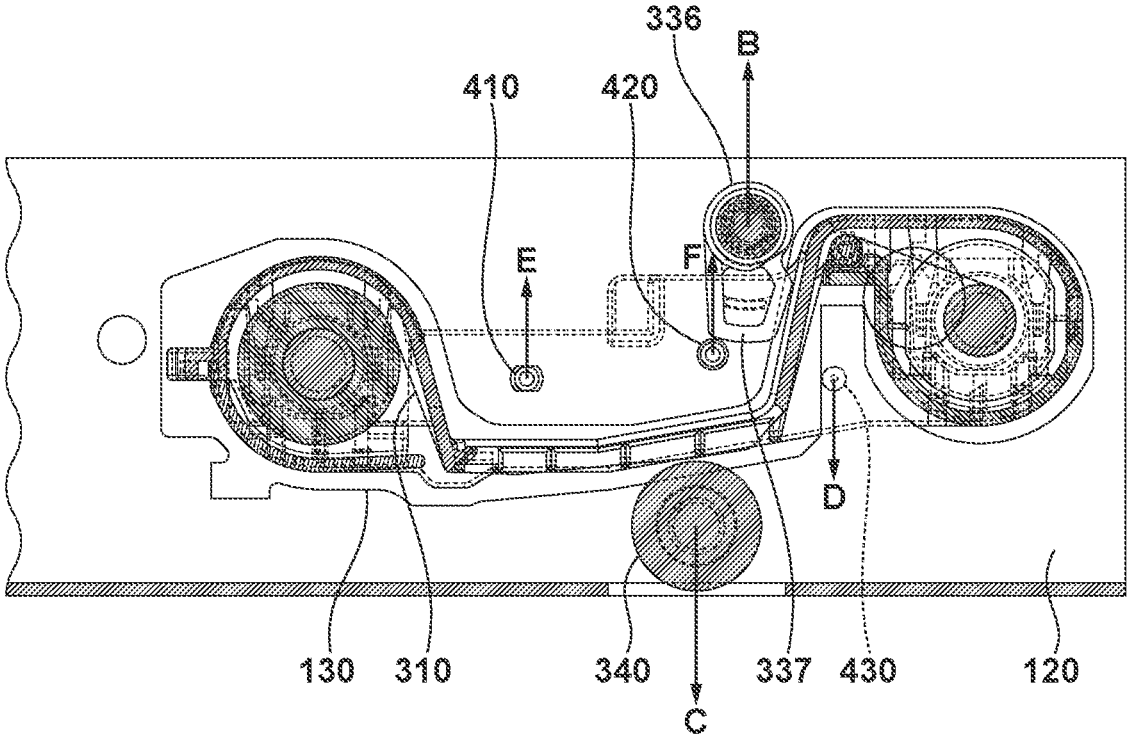
FIGS. 6A and 6B are diagrams illustrating primary elements of the printer according to the embodiment.
Figure 6B:
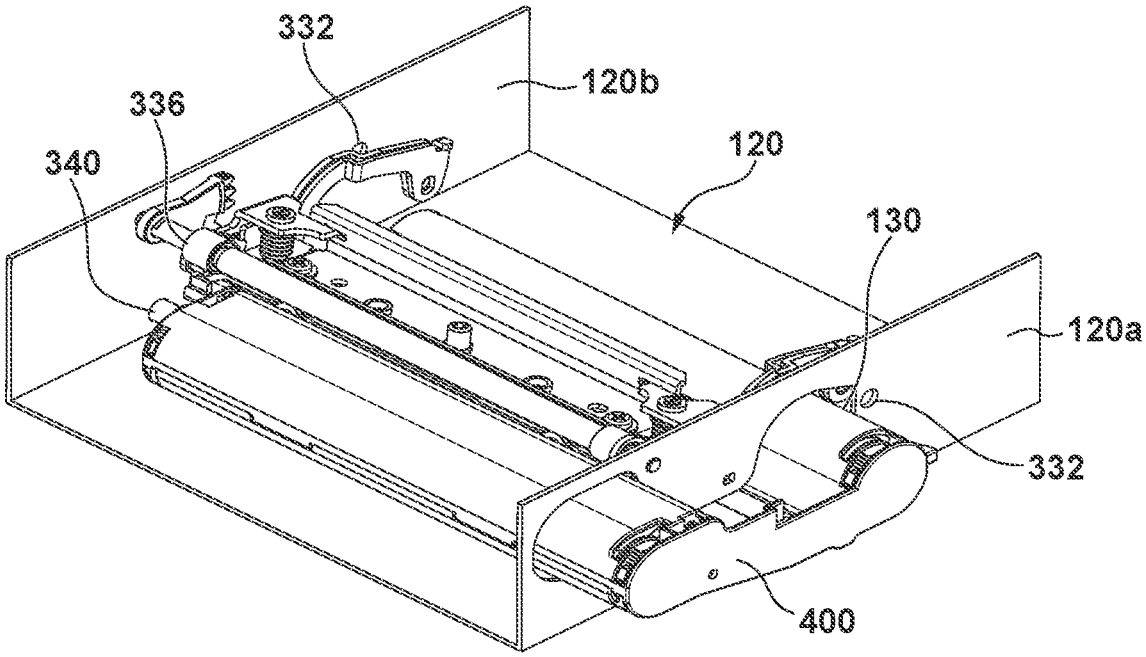

FIGS. 6A and 6B are diagrams illustrating the primary elements of the printer 100 during printing, according to the present embodiment, where FIG. 6A is a cross-sectional view of the ink cassette 300 seen from the far side in the mounting direction, and FIG. 6B is a perspective view of the ink cassette 300 seen from the near side in the mounting direction. To simplify the descriptions, FIG. 6A illustrates only the chassis 120, the ink cassette 300, the pressure contact cam 337, the platen roller 340, and the pressure contact cam shaft 336, and illustrates a state during printing in the same manner as FIG. 3D. The pressure contact cam 337 rotates about the pressure contact cam shaft 336, and presses the thermal head 330 against the platen roller 340. The chassis 120 is a support member manufactured by bending a thin galvanized steel sheet of 0.8 mm in thickness into a U-shape. As illustrated in FIG. 6B, of two side wall portions 120*a* and 120*b* formed by bending the chassis 120 into a U-shape, the one side wall portion 120*a* is provided with a cassette mounting portion 130, which is an opening for mounting the ink cassette 300, and both side wall portions 120*a* and 120*b* are provided with the bearing portions of the pressure contact cam shaft 336 and the platen roller 340.

As described with reference to FIGS. 3A to 3E, the thermal head 330 and the platen roller 340 are pressed together with a large force to stably improve the printing quality, but the pressure contact force is received by the chassis 120 through the head support shaft 332 and the respective bearing portions of the platen roller 340. In order to hold the ink ribbon 310 and the recording sheet 320 between the thermal head 330 and the platen roller 340 during printing, the thermal head 330 and the platen roller 340 are arranged vertically so that the ink ribbon 310 and the cassette mounting portion 130 following the conveyance path of the ink ribbon 310 are interposed therebetween, as illustrated in FIG. 6A. In other words, the positional relationship is such that the respective bearing portions of the pressure contact cam shaft 336 and the platen roller 340, which receive the pressure contact force of the thermal head 330 and the platinum roller 340 during printing, are disposed opposite each other above and below the cassette mounting portion 130, which is a large opening provided in the chassis 120. Accordingly, although the chassis 120 receives a large pressure contact force during printing, the side wall portion 120*a* in which the cassette mounting portion 130 is formed has a reduced strength compared to the other side wall portion 120*b*. To make the printer 100 as compact as possible, it is necessary to make the chassis 120 compact as well, which makes the chassis 120 more susceptible to a drop in strength caused by the cassette mounting portion 130. If the chassis 120 deforms due to the pressure contact force during printing, the desired pressure contact force cannot be maintained, leading to a drop in the printing density, ink not being transferred to the recording sheet 320, or the like, which in turn causes a drop in the printing quality. In particular, the cassette mounting portion 130 is provided only in the one side wall portion 120*a* of the chassis 120, and a large opening like the cassette mounting portion 130 is not provided in the other side wall portion 120*b*. Accordingly, in the direction in which the heating elements of the thermal head 330 are arranged (a main scanning direction of images), the pressure contact force on the far side in the mounting direction of the ink cassette 300 is lower than the pressure contact force on the near side. When such a difference in the pressure contact forces arises in the longer direction of the thermal head 330, a density difference will arise in the main scanning direction of the printed image, leading to a drop in the printing quality.

As illustrated in FIGS. 5A and 5B, the ink cassette 300 according to the present embodiment has the positioning boss 410, the restricting boss 420, and the positioning hole 430 provided in the connecting portion 400, which is provided on the near side of the ink cassette 300 in the mounting direction. Holes, bosses, and the like which engage with the positioning boss 410, the restricting boss 420, and the positioning hole 430 are provided in portions of the chassis 120 that correspond to the positioning boss 410, the restricting boss 420, and the positioning hole 430. As illustrated in FIGS. 6A and 6B, counterforce corresponding to the pressure contact force during printing acts on the chassis 120 in directions indicated by arrows B and C in FIG. 6A. When a force acts in the direction indicated by the arrow B, a force acts on the chassis 120 which moves the positioning boss 410 and the restricting boss 420 in the direction indicated by arrows E and F. Likewise, when a force acts in the direction indicated by the arrow C, the chassis 120 deforms, and as a result, a force which moves the positioning hole 430 in the direction indicated by arrow D is applied. Because the one side wall portion 120*a* of the chassis 120 has reduced strength due to the influence of the cassette mounting portion 130, that side wall portion 120*a* deforms comparatively easily.

Here, the positioning boss 410 and the positioning hole 430 are in a positional relationship in which the cassette mounting portion 130 is interposed therebetween, and thus the connecting portion 400 provided on the near side of the ink cassette 300 in the mounting direction receives the force indicated by the arrows D and E. Specifically, the positioning boss 410 and the positioning hole 430 restrict deformation in the side wall portion 120*a* of the chassis 120 so that a distance between the boss and the hole does not change due to the rigidity of the connecting portion 400 of the cassette case 303. However, the positioning boss 410 and the positioning hole 430 are not disposed on a straight line connecting the centers of the respective bearing portions of the pressure contact cam shaft 336 and the platen roller 340, and thus moment which rotates the cassette case 303 in what is the clockwise direction in FIG. 6A is produced. The positioning boss 410 and the positioning hole 430 function as positioning portions when mounting the ink cassette 300 in the printer 100, and thus it is necessary for those portions to be disposed as far apart as possible so as not to be affected by shape errors arising during the manufacture of the cassette case 303, the chassis 120, or the like. In the printer 100, the thermal head 330 and the platen roller 340 are disposed between the winding bobbin 301 and the supply bobbin 302, making it easy for the printer 100 to be longer in the left-right direction in the drawings. The positioning boss 410 and the positioning hole 430 are disposed as far apart as possible, and thus the positioning boss 410 and the positioning hole 430 are disposed in positions on an upstream side and a downstream side in the conveyance direction, with the thermal head 330 located therebetween. In order to reduce the size (thickness) of the printer 100 to the greatest extent possible, the platen roller 340 and the pressure contact cam shaft 336 are disposed so that the distance therebetween is as small as possible. Additionally, the restricting boss 420 is disposed approximately midway between the positioning boss 410 and the positioning hole 430 in the conveyance direction. The restricting boss 420 is, like the positioning boss 410, disposed above the cassette mounting portion 130 of the chassis 120. Accordingly, the moment that rotates the cassette case 303 in what is the clockwise direction in FIG. 6A is canceled out by the force, indicated by the arrow F, acting on the restricting boss 420. In other words, by providing all of the positioning boss 410, the positioning hole 430, and the restricting boss 420 in the connecting portion 400 of the cassette case 303, deformation of the side wall portion 120*a* of the chassis 120 is restricted so that the positional relationships of the bosses and the hole do not change. In particular, although a force that separates the restricting boss 420 and the positioning hole 430 from each other is applied as moment, the cassette case 303 and the connecting portion 400 are formed from a high-strength resin material, which makes it possible to strongly restrict displacement in the positions of the positioning boss 410, the positioning hole 430, and the restricting boss 420. Additionally, the positioning boss 410 and the restricting boss 420 are formed in a continuous surface of the connecting portion 400, and thus the positional relationship therebetween is maintained even more strongly. In other words, by providing a plurality of positioning portions or restricting portions in the same surface, of the connecting portion 400 of the cassette case 303, which does not have an element such as a hole that causes a drop in strength, the displacement of the positions can be more strongly restricted. Note that the positioning boss 410 serving as the engagement portion and the positioning hole 430 serving as the engaged portion, which are provided in the ink cassette 300, the hole serving as the engaged portion provided in the printer 100, with which the positioning boss 410 engages, and the boss provided in the printer 100, which engages with the positioning hole 430, are not limited to two each, and two or more may be provided. Additionally, the restricting boss 420 serving as the engaged portion provided in the ink cassette 300, and the hole provided in the printer 100 as the engaged portion which engages with the restricting boss 420, are not limited to one each, and one or more may be provided.

Additionally, because the positioning boss 410 and the positioning hole 430 in the connecting portion 400 of the cassette case 303 function as positioning portions when mounting the ink cassette 300 in the printer 100, the diameter of the hole that fits with the boss is set to the smallest possible clearance. Specifically, the shaft diameter of the boss is set to a diameter which is greater than the diameter of the hole, to ensure a tight fit. On the other hand, the diameter of the hole into which the restricting boss 420 fits has the minimum necessary gap so as to ensure that the boss and the hole do not interfere with each other. Although the minimum necessary gap permits deformation in the chassis 120, the deformation is within a range at which there is no effect on the printing quality by a drop in pressure contact force caused by the deformation. Specifically, the shaft diameter of the restricting boss 420 is set to φ2.2±0.05 mm, and the hole diameter is set to φ2.35±0.05 mm. In contrast to the maximum shaft diameter of the restricting boss 420, which is φ2.15 mm, the hole diameter is φ2.40, allowing 0.125 mm of movement (deformation). However, the reduction in pressure contact force due to this deformation is kept within the range where the printing quality can be ensured.

While the present disclosure has been described with reference to an exemplary embodiment, it is to be understood that the disclosure is not limited to the disclosed exemplary embodiment. The scope of the following claims is to be accorded the broadest interpretation so as to encompass all such modifications and equivalent structures and functions.

This application claims the benefit of Japanese Patent Application No. 2020-015531, filed Jan. 31, 2020, which is hereby incorporated by reference herein in its entirety.

What is claimed is:

1. An ink cassette to be mounted in a printer through an opening in a support member of the printer, the ink cassette comprising:

a winding bobbin;

a supply bobbin;

an ink sheet wound around the winding bobbin and the supply bobbin; and a plate member having a first engaging portion and a second engaging portion, wherein, when the ink cassette is mounted in the printer, the plate member is position adjacent to the chassis opening and the first engaging portion and the second engaging portion are engaged with the support member, wherein, in a case where the ink sheet and a print sheet are held in contact by a force from a print head and a receiving member of the printer during a printing operation, the first engaging portion and the second engaging portion maintain printing quality by cooperating to counter forces from the print head and the receiving member acting to deform the support member.

2. The ink cassette according to claim 1, wherein the first engaging portion and the second engaging portion are provided at positions opposing each other with a conveyance path of the ink sheet located between the positions.

3. The ink cassette according to claim 1, wherein the printer includes the print head, the receiving member to receive a pressure contact force of the print head, a raising/lowering mechanism configured to press and separate the print head against and from the receiving member over the ink sheet and the print sheet, and the support member configured to support the receiving member and the raising/lowering mechanism, and wherein the ink cassette is capable of being inserted into and removed from the printer through an opening provided in the support member.

4. The ink cassette according to claim 1, wherein the receiving member is configured to receive a pressure contact force of the print head, and includes the support member having the opening and is configured to support the receiving member, wherein the support member opening is configured to receive insertion of the ink cassette into the printer and permit removal of the ink cassette from the printer, wherein the first engaging portion and the second engaging portion are part of at least three engaging portions of the ink cassette which include an ink cassette engagement portion configured to engage with an engaged portion of the printer, and include an ink cassette engaged portion configured to engage with an engagement portion of the printer, wherein the engaged portion of the printer includes a first engaged portion and a second engaged portion, each provided on a first side of the support member opening that is opposite from the receiving member with respect to a conveyance direction of the ink sheet, and wherein the engagement portion of the printer includes a third engagement portion provided on a second side of the support member opening that is opposite the first side, wherein the ink cassette engagement portion includes a first engagement portion configured to engage with the printer first engaged portion and includes a second engagement portion configured to engage with the printer second engaged portion, and wherein the ink cassette engaged portion includes a third engaged portion configured to engage with the printer third engagement portion, and wherein the ink cassette first engagement portion, the ink cassette second engagement portion, and the ink cassette third engaged portion are provided in a continuous surface of the plate member.

5. The ink cassette according to claim 4, wherein the ink cassette first engagement portion and the ink cassette second engagement portion are positioned to respectively engage with the printer first engaged portion and the printer second engaged portion that are disposed in positions on an upstream side and a downstream side, respectively, of the print head with respect to the conveyance direction.

6. The ink cassette according to claim 4, wherein the printer first engaged portion and the printer second engaged portion are holes and the ink cassette first engagement portion and the ink cassette second engagement portion are shafts configured to fit into these holes, and wherein the printer third engagement portion is a shaft and the ink cassette third engaged portion is a hole configured to receive the shaft that is the printer third engagement portion.

7. The ink cassette according to claim 6, wherein a shaft diameter of the ink cassette second engagement portion shaft is greater than a hole diameter of the printer second engaged portion hole, and a hole diameter of the ink cassette third engaged portion hole is smaller than a shaft diameter of the printer third engagement portion shaft, and wherein the ink cassette second engagement portion and the printer second engaged portion as a pair, and the ink cassette third engaged portion and the printer third engagement portion as a pair each cooperate to position the ink cassette with respect to the printer.

8. The ink cassette according to claim 6, wherein a shaft diameter of the ink cassette first engagement portion shaft is smaller than a hole diameter of the printer first engaged portion hole and configured to provide a fit that permits deformation of the support member by the pressure contact force and to keep a drop in the pressure contact force caused by the deformation in the support member within a predetermined range.

9. The ink cassette according to claim 4, wherein the ink cassette second engagement portion is configured such that, in a case where the ink cassette second engagement portion is subjected to a force, the ink cassette second engagement portion cancels out moment of a force that is produced by counterforce of the pressure contact force and that acts on the ink cassette first engagement portion and the ink cassette third engaged portion.

10. The ink cassette according to claim 1, further comprising:

a winding bobbin storage portion configured to support the winding bobbin; and a supply bobbin storage portion configured to support the supply bobbin, wherein the plate member connects the winding bobbin storage portion and the supply bobbin storage portion at a near side of the ink cassette in a mounting direction of the ink cassette.

11. The printer according to claim 10, wherein two of the at least three engaging portions of the ink cassette are provided at positions opposing each other with a conveyance path of the ink sheet located between the positions, and wherein at least one of the three ink cassette engaging portions is an engagement portion and the other of the three ink cassette engaging portions is an engaged portion, and wherein an engaged portion of the printer engages with the ink cassette engagement portion when the ink cassette is mounted in the printer, and an engagement portion of the printer engages with the ink cassette engaged portion when the ink cassette is mounted in the printer.

12. The printer according to claim 10, wherein the at least three engaging portions of the ink cassette include an ink cassette engagement portion, an ink cassette engaged portion, an ink cassette first engagement portion, an ink cassette second engagement portion, and an ink cassette third engaged portion, wherein an engaged portion of the printer is configured to engage with the ink cassette engagement portion, and an engagement portion of the printer is configured to engage with the ink cassette engaged portion, wherein the engaged portion of the printer includes a first engaged portion and a second engaged portion, each provided on a first side of the support member opening that is opposite from the receiving member with respect to a conveyance direction of the ink sheet, and wherein the engagement portion of the printer includes a third engagement portion provided on a second side of the support member opening that is opposite the first side, wherein the printer first engaged portion is configured to engage with the ink cassette first engagement portion, the printer second engaged portion is configured to engage with the ink cassette second engagement portion, and the printer third engagement portion is configured to engage with the ink cassette third engaged portion, and wherein the ink cassette first engagement portion, the ink cassette second engagement portion, and the ink cassette third engaged portion are provided in a continuous surface of a plate member provided in an end part on a near side of the ink cassette in a mounting direction.

13. The printer according to claim 12, wherein the printer first engaged portion and the printer second engaged portion are disposed in positions on an upstream side and a downstream side, respectively, of the print head with respect to the conveyance direction to respectively engage with the ink cassette first engagement portion and the ink cassette second engagement portion.

14. The printer according to claim 12, wherein the ink cassette first engagement portion and the ink cassette second engagement portion are shafts and the printer first engaged portion and the printer second engaged portion are holes configured to receive these shafts, and wherein the ink cassette third engaged portion is a hole and the printer third engagement portion is a shaft configured to fit into the hole that is the ink cassette third engaged portion.

15. The printer according to claim 14, wherein a hole diameter of the printer second engaged portion hole is smaller than a shaft diameter of the ink cassette second engagement portion shaft, and a shaft diameter of the printer third engagement portion shaft is greater than a hole diameter of the ink cassette third engaged portion hole, and wherein the printer second engaged portion and the ink cassette second engagement portion as a pair, and the printer third engagement portion and the ink cassette third engaged portion as a pair each cooperate to position the printer with respect to the ink cassette.

16. The printer according to claim 14, wherein a hole diameter of the printer first engaged portion hole is larger than a shaft diameter of the ink cassette first engagement portion shaft and configured to provide a fit that permits deformation of the support member by the pressure contact force and to keep a drop in the pressure contact force caused by the deformation in the support member within a predetermined range.

17. The ink cassette according to claim 1, further comprising a cassette case that contains the ink ribbon, wherein the plate member further includes a third engaging portion that engages with the support member when the ink cassette is mounted in the printer, and wherein the third engaging portion is positioned between the first engaging portion and the second engaging portion in such a way as to counter any moment force, resulting from the force between the print head and the receiving member, that acts to rotate the cassette case.

18. The ink cassette according to claim 17, wherein the support member is a chassis, the ink sheet is an ink ribbon, the first engaging portion is a positioning boss, the second engaging portion is a positioning hole, the third engaging portion is a restricting boss, the print head is a thermal head, the receiving member is a platen roller, the force is a predetermined pressure contact force between the thermal head and the platen roller, and wherein, in a case where the ink ribbon, pulled out from the supply bobbin, and the print sheet are overlaid and pressed against the thermal head of the printer, ink is transferred from the ink sheet ribbon to the print sheet.

19. A printer configured to mount an ink cassette in the printer, wherein the ink cassette includes at least three engaging portions and a supply bobbin on which an ink sheet, that is long and coated with ink, is wound, the printer comprising:

a print head;

a receiving member configured to receive a pressure contact force of the print head;

a raising/lowering mechanism configured to press and separate the print head against and from the receiving member;

a support member having an opening and configured to support the receiving member and the raising/lowering mechanism, wherein the support member opening is configured to receive insertion of the ink cassette into the printer and permit removal of the ink cassette from the printer; and engaging portions configured to engage with the at least three engaging portions of the ink cassette when the ink cassette is mounted in the printer, wherein, in a case where the ink sheet, pulled out from the supply bobbin, and a print sheet are overlaid and pressed against the print head, ink is transferred from the ink sheet to the print sheet.

20. The printer according to claim 19, wherein an engaging portion provided in the support member of the printer is configured to engage with an engagement portion of the ink cassette.

* * * * *